US010344984B2

(12) United States Patent
Golomb

(10) Patent No.: US 10,344,984 B2
(45) **Date of Patent: *Jul. 9, 2019**

(54) SAFETY BURNER SYSTEM WITH AUTOMATIC SHUT-OFF

(71) Applicant: Golomb Mercantile Company LLC, Las Vegas, NV (US)

(72) Inventor: Adam Simon Golomb, Las Vegas, NV (US)

(73) Assignee: GOLOMB APPLIED SCIENCES LLC, Las Vegas, NV (US)

( * ) Notice: Subject to any disclaimer, the term of this patent is extended or adjusted under 35 U.S.C. 154(b) by 165 days.

This patent is subject to a terminal disclaimer.

(21) Appl. No.: 15/472,137

(22) Filed: Mar. 28, 2017

(65) Prior Publication Data

US 2017/0198920 A1 Jul. 13, 2017

Related U.S. Application Data

(63) Continuation of application No. 14/211,442, filed on Mar. 14, 2014, now Pat. No. 9,638,426.

(Continued)

(51) Int. Cl.

*F24C 3/12* (2006.01)
*F23N 5/24* (2006.01)

(Continued)

(52) U.S. Cl.

CPC ..... *F24C 3/124* (2013.01); *F23D 14/72* (2013.01); *F23N 5/082* (2013.01); *F23N 5/242* (2013.01);

(Continued)

(58) Field of Classification Search

CPC ..... F23N 5/082; F23N 5/242; F23N 2023/54; F23N 2029/20; F23N 2031/00;

(Continued)

(56) References Cited

U.S. PATENT DOCUMENTS 5,094,259 A 3/1992 Hsu
5,136,277 A 8/1992 Civanelli et al.

(Continued)

FOREIGN PATENT DOCUMENTS

EP 2 230 461 9/2010
WO WO 2008/031645 3/2008

OTHER PUBLICATIONS

U.S. Consumer Product Safety Commission, Washington, D.C. 20207, Jun. 25, 2001 Memo to the Commission from R. L. Medford Re: Contractor Report on Feasibility of Modifying Range Designs to Address Cooking Fires with (Tab A). Final Report entitled Technical, Practical and Manufacturing Feasibility of Technologies to Address Surface Cooking Fires, Arthur D. Little, Reference 72931, May 22, 2001, pp. 1-4-56.

(Continued)

*Primary Examiner* — Alfred Basichas
(74) *Attorney, Agent, or Firm* — Clark Hill PLC

(57) ABSTRACT

A gas burner safety system comprises dual sensor arrays, the first array positioned proximal to the gas burner and the second array positioned proximal to a control used to turn on and off and regulate the flame of the gas burner. The first array senses the flame components such that a flame signature is obtained when no object is placed on or above the flame and a flame image is obtained when an object is proximal to the flame. By comparing the flame signature and the flame image, a central control unit operatively connected to the sensor arrays can determine the presence or absence of an object proximal to the flame. The second sensor array is positioned to detect a human hand proximal to the control. In operation, if the flame image matches the flame signature and a human hand is not detected proximal to the control, the central control unit turns off the gas burner by causing the closure of a valve in the gas supply line to the gas burner.

20 Claims, 3 Drawing Sheets

Related U.S. Application Data

(60) Provisional application No. 61/784,391, filed on Mar. 14, 2013.

(51) Int. Cl.
*F23N 5/08* (2006.01)
*F23D 14/72* (2006.01)

(52) U.S. Cl.
CPC ..... *F24C 3/122* (2013.01); *F24C 3/126* (2013.01); *F23N 2023/54* (2013.01); *F23N 2029/20* (2013.01); *F23N 2031/00* (2013.01); *F23N 2041/08* (2013.01)

(58) Field of Classification Search
CPC ..... F23N 2041/08; F23D 14/72; F24C 3/124; F24C 3/122; F24C 3/126
See application file for complete search history.

(56) References Cited

U.S. PATENT DOCUMENTS

| | | | |
|---|---|---|---|
| 5,628,242 | A | 5/1997 | Highley et al. |
| 6,253,761 | B1 | 7/2001 | Shuler et al. |
| 6,322,352 | B1 | 11/2001 | Zink |
| 7,710,280 | B2 | 5/2010 | McLellan |
| 9,638,426 | B2 * | 5/2017 | Golomb ..... F23N 5/082 |
| 2002/0094498 | A1 | 7/2002 | Rodriguez-Rodriguez et al. |
| 2007/0072137 | A1 | 3/2007 | Peluso et al. |

OTHER PUBLICATIONS

"Home Structure Fires" by Marty Ahrens, National Fire Protection Association, Fire Analysis and Research Division, Aug. 2012, pp. 1-120.

"Home Fires Involving Cooking Equipment", by Marty Ahrens, National Fire Protection Association, Fire Analysis and Research Division, Nov. 2011, pp. 1-193.

National Fire Protection Association NFPA Codes and Standards, p. 1.

Landon IP Search Results, "A Safety Burner System with Automatic Shut Off", Director, Long Nguyen, Esq., pp. 1-3.

Written Opinion of the International Searching Authority which issued in connection with related international application No. PCT/US2014/028392 dated Aug. 1, 2014

* cited by examiner

SAFETY BURNER SYSTEM WITH AUTOMATIC SHUT-OFF

PRIORITY

This application claims priority from U.S. Provisional Patent Application No. 61/784,391, filed Mar. 14, 2013, and U.S. Utility patent application Ser. No. 14/211,442, filed Mar. 14, 2014.

FIELD OF THE INVENTION

The apparatus, systems and methods described herein relate to an ergonomic design that makes use of sensors in a computerized control circuit to determine when a flame on a gas cooking surface should be turned off. Accordingly, the inventions described herein relate to improvements in the safe operation of gas cooking surfaces.

BACKGROUND

Fires related to unattended gas burners on a cooking surface have long been recognized as a problem in need of a practical, effective solution. In a 2001 report to the U.S. Consumer Product Safety Commission (the "Report"), Arthur D. Little reported on possible technologies that could address cooktop fires. The Report reviewed 111 technologies, most of which focused on systems designed to determine whether a person was in proximity of the range, systems to measure the temperature of a cooking utensil or a cooking surface, and systems to detect, warn, and extinguish a fire.

In the interval since 2001, it appears that no technology identified in the Report has been widely accepted as a means to address the hazard of home cooking fires. According to the National Fire Protection Association Fire Analysis and Research Division (the "NFPA"), between 2006 and 2010, fire departments in the United States responded to an average of 90,400 home structure fires per year in which a range or cooktop was involved as a contributing cause of the fire. Such fires caused an annual average of 330 civilian deaths, 3,740 reported civilian injuries, and $571 million in property damage. The NFPA also reported that between 2005 and 2009, 84% of civilian deaths which involved cooking equipment were due to fires involving cooking range tops.

Civanelli, U.S. Pat. No. 5,136,277, envisioned using charged capacitor plates on the cooking surface to sense when a cooking utensil, such as a pot or pan, was moved about the cooking surface. Shuler, U.S. Pat. No. 6,253,761, describes a weight sensor under a burner which communicates with a solenoid that turns a gas supply on when weight is detected and which turns the gas supply off when weight is removed from the burner. Higley, U.S. Pat. No. 5,628,242, describes a system that shuts off the gas supply to a gas grill that has not been used for a preselected time period. According to Higley, an adjustable timer is used to shut off the gas supply after no motion has been detected for a preselected time period. Motion detection is accomplished using a lid position sensor to detect when the grill lid is moved between the open and the closed position, a detector which monitors switch usage to detect activity, and a vibration or movement detector which monitors when the grill itself has been moved. Coppola, WO2008031645, describes the use of fiber optic sensors to sense when a pot or pan is on a cooking surface. If the pot or pan is detected, then gas is allowed to flow to the burner. A timer allows gas flow to the burner for a pre-set period of time after a pot or pan is no longer detected on the burner. Other devices are known which sense general movement around a range and then turn off the range if no movement is detected after a predetermined interval. The simplest prior art safety device is a timer which turns off the gas supply to a range if the range has been in use for twelve hours.

Each of the prior art devices only senses when a cooking utensil is on a burner surface when there is general motion in the vicinity of a range or when the range has been in use for too long a period of time. Depending on what type of meal is being prepared, weight sensors or fiber-optic sensors that are used to determine when a utensil is on a burner may not be practical. If a meal requires the regular removal and replacement of a utensil, such as when cooking with a wok, it may be difficult to find a timer setting that adequately covers the range of movements which accompany such cooking and the burner may be turned off prematurely or be left on long after cooking has ceased. Likewise, detectors which rely on movement of a cooking appliance itself or on sensing movement in the general vicinity of the range may prove impractical as events that are within the normal range of cooking activities may cause a gas burner to be shut down prematurely. Likewise, events that are not part of the cooking activities may cause a burner to stay lit when it should be shut down for safety reasons. Thus, such devices fail to operate in a way that is consistent with how a human operator uses a range.

Thus, one of the challenges the prior art devices fail to accommodate is the nearly infinite variations in size and shape of cooking utensils, as well as the size, shape and mannerisms of a human operator.

Other types of temperature sensors such as passive infrared sensors ("PIR sensors") for example, do not actually detect the movement of an object or its presence; rather PIR sensors are electronic sensors which measure infrared radiation ("IR") from objects within their field of view. All objects with a temperature above absolute zero emit heat energy in the form of IR which enables PIR sensors to detect changes in temperature at a given point. Such may be interpreted as the movement of an object. An item of constant temperature that does not move is invisible. A motionless item which changes temperature is visible. This poses a gap in detection which is problematic in the instance of a cooking utensil, such as a pot of tepid water, that is intentionally left to boil. Under constant boiling, the temperature of the pot may change so little that a PIR sensor may lack the sensitivity to detect such a change. A stationary utensil that is being tended to by a human operator who creates a separate heat signature and is moving in and out of the zone of detection of the PIR sensor may be difficult to monitor. Such difficulties in using PIR sensors and the like could lead to misreadings and inadvertent shut-offs of a gas burner.

Therefore, what is needed is a safety burner system which operates in an ergonomic fashion and which accommodates the range of activities likely to be performed around a burner while a meal is being prepared. What is further needed is a safety burner system that intelligently interacts with a human operator of a gas range.

SUMMARY OF THE INVENTION

Embodiments of the present invention provide:

A gas burner safety system for use on a gas range, the gas burner safety system comprising:

a manual control;

the manual control operatively connected to a valve;

the valve connected across a gas supply line, such that the valve may turn off and turn on the gas supply;

the gas supply line connected to a burner on the gas range;

a range sensor placed proximally to the perimeter of the burner, wherein the range sensor detects the temperature of the area around the burner;

a manual control sensor placed around the perimeter of the manual control, wherein the manual control sensor detects the temperature of the area around the manual control;

the range sensor and the manual control sensor operatively connected to a central control unit, the central control unit including a memory;

the central control unit operatively connected to the valve;

a flame signature for the burner stored in the memory, wherein the flame signature is determined by the range sensor for a naked flame;

a flame image for the burner stored in the memory, wherein the flame image may be the same or different than the flame signature; and wherein the central control unit closes the valve which shuts off the gas supply line if the flame signature is the same as the flame image and the manual control sensor does not detect the temperature of a human hand around the manual control.

Embodiments of the present invention further provide a method for determining when an object such as a pot or pan is placed on or above a grate of a gas burner, based on a comparison of the flame signature and the flame image. The flame signature is defined by a collection of data points gathered via PIR sensor(s) located around the perimeter of the gas burner for a naked flame, that is a flame above which there is no pot or no pan. The flame image is defined by a collection of data points gathered via the PIR sensors for a flame above which a pot or pan may be placed. A comparison of the flame signature to the flame image can thus be used to determine if a pot or pan is positioned on or above the range.

Embodiments of the present invention further provide a burner safety system which will shut off an unattended gas range burner if no object such as a pot or pan is placed on or above a grate above the burner.

Embodiments of the present invention also provide a method for determining when a human hand is near or around the manual control, manual dial, or similar controller, used to turn off and turn on a gas range burner. PIR sensor(s) located around the perimeter of the dial are used to detect the temperature of a human hand, which is different than the background temperature, and thus by comparison with the background temperature, the presence or absence of a human hand can be determined.

Embodiments of the present invention also provide an integrated burner safety system which includes a central control unit, the central control unit including a microprocessor, logic circuits and memory. The central control unit is operatively connected with a solenoid valve, the solenoid valve used to regulate gas flow to a burner on a gas range. The central control unit is also operatively connected to sensor(s) placed around the perimeter of the burner and around the perimeter of the dial used to manually turn on and off the gas flow to the burner and to ignite the gas at the burner. Based on information received from the sensor(s), the integrated burner safety system can determine when a gas burner has no object placed above or on it and when no human hand is around the dial. Under such conditions, the integrated safety burner system automatically shuts off the burner.

DETAILED DESCRIPTION

Figure 1A:
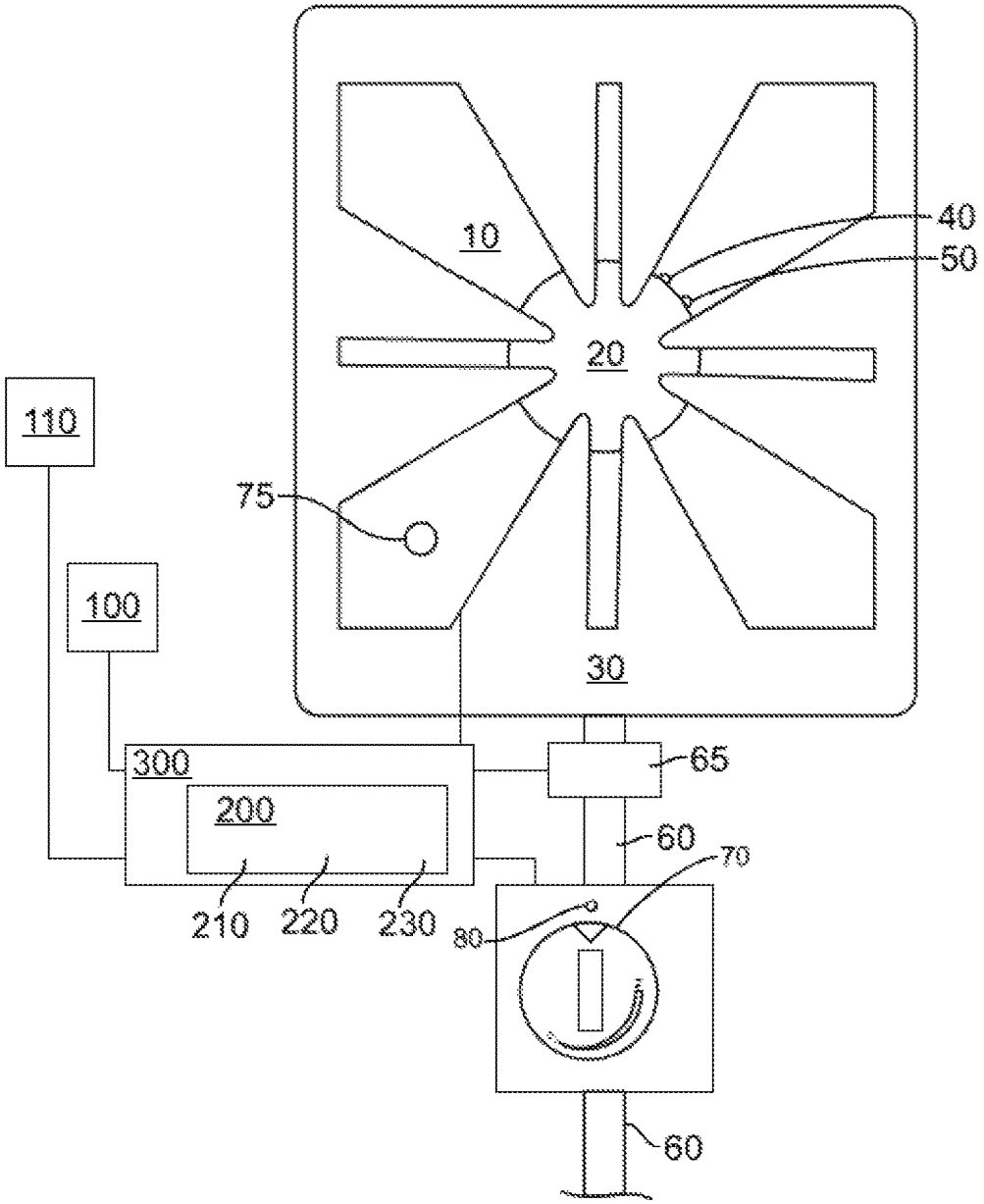
FIG. 1A illustrates a gas burner and related components of the present invention, including a range sensor.

Careful people may leave a cooking flame unattended because their hands must perform a variety of activities that routinely occur while a meal is being cooked which concurrently require a human operator to step away from the burner. For example, when the food is sufficiently cooked, a human operator will move away from the range either: (1) holding a pot with both hands; or (2) holding a pan in one hand and a stirring spoon/spatula/fork, in the other. Under such circumstances, the gas flame may not get turned off unless done consciously prior to removing the cooking utensil from the range top. A low burning blue flame is almost silent and can be easily forgotten. Thus, turning off a flame requires vigilance and memory. Due to the logistical challenges with turning off a flame, many people knowingly walk away from a burning flame, or turn their back on it with the intention of returning quickly to shut it off. The risk of fire or injury in the interval is still present.

A flame is often left on and unattended after a cooking session is finished because the human operator's attention travels with the food. At such a point in a meal preparation process, the human operator has moved on to the next step in prepping, serving or eating the meal. The food that has just been cooked monopolizes the focus, attention, and senses of the human operator.

A human operator's relationship with a cooking flame is visual; we like to see it go on and off. We often ignite flames before placing a cooking implement on the grate of a range in order to visually determine the desired flame level. We often remove the pot or pan before turning the flame off, because we: (1) want to cook until the last moment; and (2) want to see the flame shut off.

Accordingly, when taking the human experience into account, it is understandable why safety devices of the prior art have failed to function ergonomically. The expectation of the prior art appears to be that human operators will conform their activities to those activities that make the prior art safety devices function as opposed to the devices themselves adapting to the activities of the human operators.

Common residential gas burner stoves are typically fueled by an external fuel source (natural gas in most homes or a propane tank) that is connected to the stove via pipelines that enter the house from underground. The gas that enters the pipes is pressurized, such that when the burner is turned on, the gas line is opened and the fuel is permitted to flow into the stove's pipes towards the burner where it mixes with air which provides for a blue, controllable flame.

After mixing with air, the fuel/air mixture continues toward the burner and eventually is funneled through multiple holes around the burner base. One or more of these small holes emits the fuel/air mixture directly in the path of an electric spark igniter which is the source of ignition. When the stove burner is set to "light," clicking sounds are heard as the igniter's sparks make contact with the fuel, igniting the flame. Flame controls on the stove, such as dials, regulate the amount of gas which vary the size and intensity of the flame.

Although persons having ordinary skill in the art will appreciate the various ways in which gas burners may be plumbed, the following common characteristics of gas burner plumbing is provided for illustrative purposes. A gas burner system therefore may include the following:

1) Gas Inlet Port (contains pressurized gas from the main lines).
2) Solenoid Valve comprising:
   a) Solenoid Coil (creates electromagnetic field when energized);
   b) Lead Wires (connects the Solenoid Valve to an Electronic Circuit, Central Control Unit and Power Source);
   c) Plunger (responsible for opening and closing an Orifice—to be moved in opposite directions by electromagnetism and/or Spring);
   d) Spring (above the Plunger which pushes the Plunger down into the Orifice when the Solenoid Coil is not energized thus closing the Solenoid Valve);
   e) Orifice (small opening which may be on the Outlet Port side of the Solenoid Valve and opened and closed by the location of the Plunger); and
   f) Power Source.
3) Gas Outlet Port (may be pressurized or depressurized depending on the open or closed state of the Solenoid Valve).
4) Electronic Circuit with a Switch Relay (through which an outside power source will be delivered) that will be open when de-energized and closed when energized from a power source per the command of a Manual Control Dial.
5) Manual Control Dial (controls the flow of gas and ignition and is the only component that can initiate the flow of gas and ignite the gas). The Manual Control Dial has a range of motion that controls the size of a gas burner's flame from low to high.

In one embodiment of the present invention, a safety burner system includes a PIR sensor, or an array of PIR sensors, positioned proximal to a gas burner such that the components of the gas burner's flame are within the field of view of the PIR sensor(s). The PIR sensor(s) is connected, either wirelessly or by wire, to a logic circuit having a memory device or to a programmable logic device. The logic circuit may be of a standard type which consists of an array of logic gates and which is capable of performing operations on digital data input to the logic circuit. The memory device is capable of storing digital data and may be, for example, a random access memory. Likewise, the programmable logic device may be of a standard type that includes a memory device. A microprocessor has the functionality of a logic circuit, memory device and programmable logic device. A Central Control Unit, which includes a microprocessor, will be used to further describe the present embodiment. However, persons having ordinary skill in the art will understand that other combinations of logic and memory devices, including computers, may be used in the present embodiment. Accordingly, the Central Control Unit is connected to the Solenoid Valve which functions to turn on and turn off gas flow to the gas burner. The Central Control Unit includes programmed into its memory the entire "PIR Range" of a "naked" gas burner flame. That is to say that the temperature range of the gas burner flame from its lowest setting to its highest setting as sensed by the PIR sensor(s) when no pot or pan or the like is placed on or near the burner in a way that contacts or distorts the burner flame (the "PIR Range") is stored in the microprocessor's memory. Where an array of PIR sensors or an equivalent is used, an effective spatial image of the "naked" burner flame can be obtained, from its lowest setting to its highest setting, and stored in the Central Control Unit's memory. Thus, the present invention provides a system and method for obtaining a unique flame signature for each burner on a gas range.

A second PIR sensor or array of sensors is positioned proximal to the Manual Control Dial and may be used to detect the presence of a human hand near the Manual Control Dial. Like the PIR sensor(s) of the gas burner, the PIR sensor(s) of the Manual Control Dial as well as the Manual Control Dial itself may be individually connected, either wirelessly or by wire, to a logic circuit having a memory device or to a programmable logic device. A human hand also has the characteristic of heat and movement and will be recognized by the PIR sensor(s) located proximal to the Manual Control Dial. In operation, with a gas burner lit, if the PIR sensor(s) located proximal to the gas burner detect a temperature that is within the PIR Range and the PIR sensor(s) located proximal to the Manual Control Dial do not detect a temperature associated with the presence of a human hand, the gas will shut off within a preset time. A timer may be set to provide a time range to account for human hand to Manual Control Dial movement, so as to avoid inadvertent shut-off of the gas burner.

The PIR Range stored in the Central Control Unit's memory defines the naked flame signature. The following steps outline one embodiment of the present invention with respect to a determination as to whether a lit burner should be turned off or left on.

1. Does the PIR sensor(s) proximal to the burner sense the naked flame signature?
2. If yes, does the PIR sensor(s) proximal to the Manual Control Dial sense the presence of a human hand within a first preset time range?
3. If yes, then the gas stays on.
4. Alternately, does the PIR sensor(s) proximal to the burner sense the naked flame signature within a first preset time range?
5. If yes, does the PIR sensor(s) proximal to the Manual Control Dial sense the presence of a human hand within a second preset time range?
6. If no, then the gas shuts off within a third preset time range.
7. Alternately, is the flame signature present?
8. If no (meaning a pot or pan is over the burner), the gas stays on.

As described above, once the PIR Range is stored into the memory of the Central Control Unit, the safety burner system of the present invention has the basis on which to detect temperatures using the PIR sensor(s) and compare the temperatures to standard ranges of values stored in the Central Control Unit's memory and thus determine whether to shut off the gas flow to the gas burner or to allow the gas flow to continue. Alternatively, the safety burner system may comprise one or more optical sensors, or a combination of PIR and optical sensors, that may be used to compare certain attribute(s) of the burner area and manual control area to provide a gas burner safety control system and method in a manner analogous to any of the embodiments described herein. An attribute is any burner area characteristic that may be subject to change over time. For example, one or more cameras may be used to detect the presence or absence of an object set about the burner during a preselected time period. Such a detected image is an example of a measured attribute.

A stored attribute, on the other hand, is an attribute stored in the memory of the Central Control Unit. For example, a stored attribute may include data which defines an object set about a burner. If a measured attribute matches a stored attribute, the Central Control Unit can be set to cause the solenoid valve to close. Alternatively, if a stored attribute contains data defining a human hand about or in proximity to the burner, and the measured attribute matches the stored attribute, then the Central Control Unit can be set to cause the valve to remain open. Other measured attributes and stored attributes may be envisioned within the scope of the present invention which provide the critical comparative step of the operation of the gas burner safety control system and method of the present invention.

In yet another example, when an object such as a pot or pan is placed on or above the grate above a lit gas burner, the temperature measured near the gas burner may, for example, be less than the temperature of the naked burner flame for a corresponding setting on the Manual Control Dial. Under such circumstances, the temperature near a gas burner on which a pot or pan has been placed will be lower than the temperature without the pot or pan for the same Manual Control Dial setting. If any object such as a pot or pan is above the flame—either on the grate, or in the space above the grate while an operator stirs, flips, tastes, moves, blends, or the like, the food in the pot or the pan, the PIR sensor(s) will recognize a reading other than the PIR Range and the burner will remain on. The PIR Range may be set in the Central Control Unit at the factory and/or post-installation into a home so as to account for differentiations in lighting and surroundings.

Figure 1B:
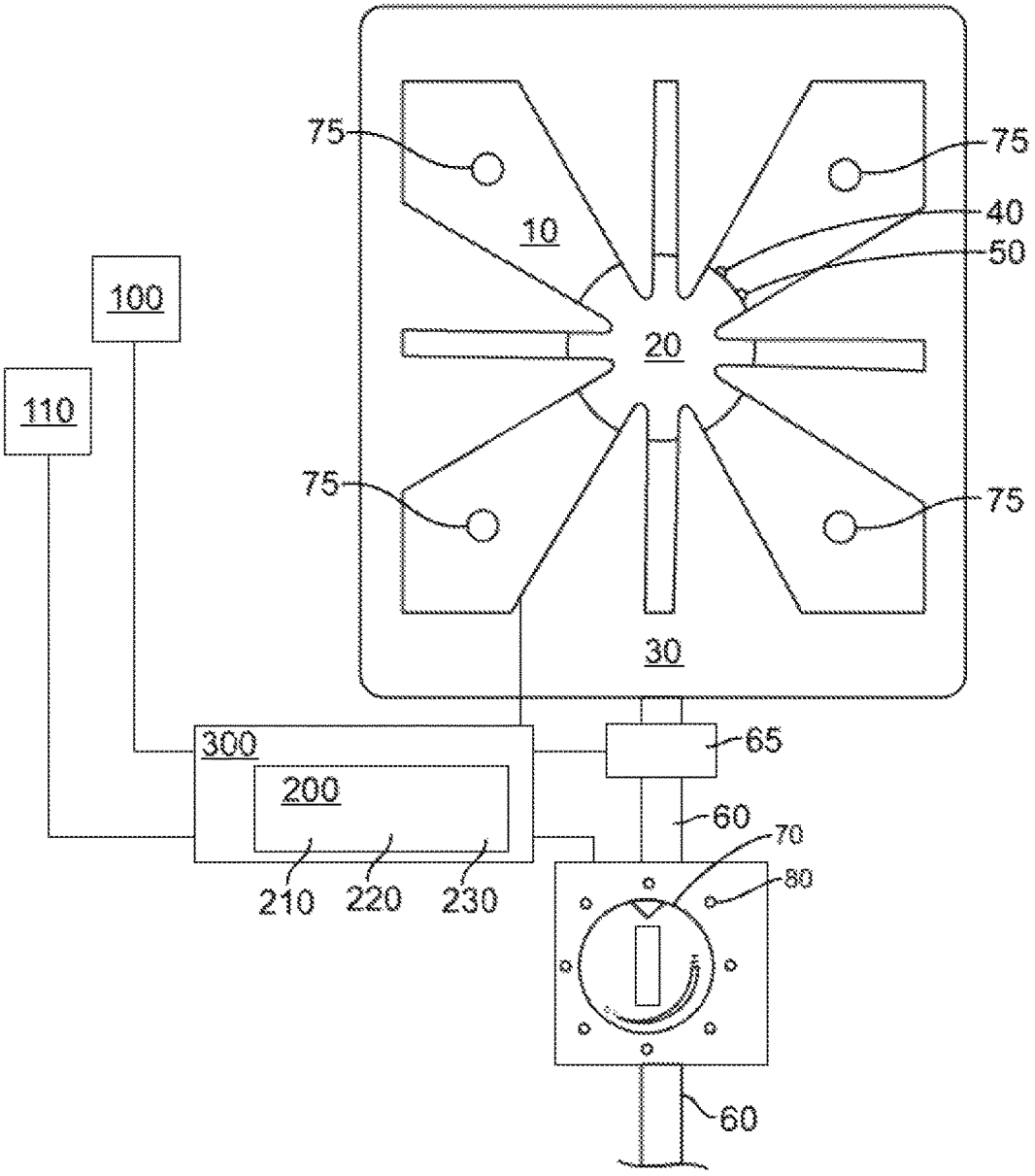
FIG. 1B illustrates a gas burner and related components of the present invention, including a plurality of range sensors.
Figure 2A:
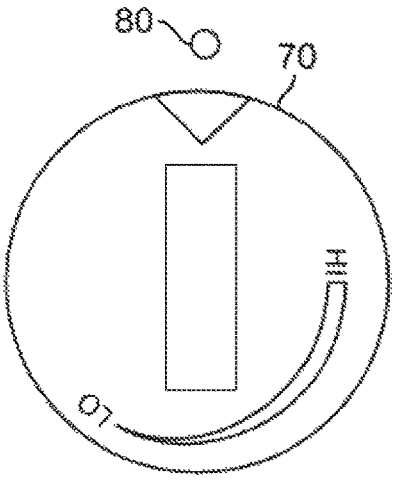
FIG. 2A illustrates a Manual Control Dial for a gas range of the present invention, including a dial sensor.
Figure 2B:
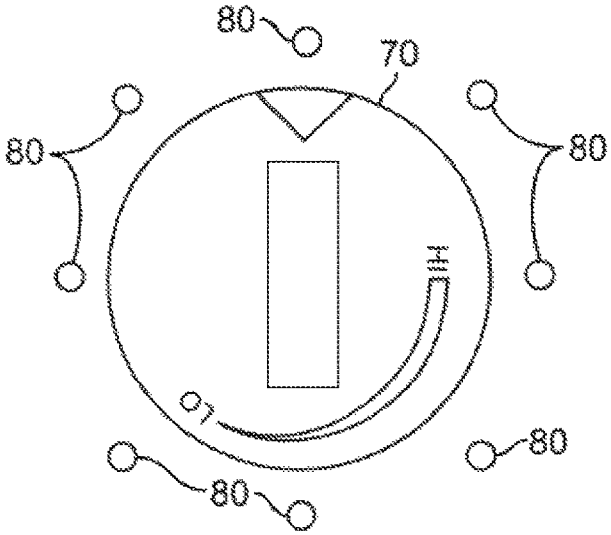
FIG. 2B illustrates a Manual Control Dial for a gas range of the present invention, including a plurality of dial sensors.

Referring now to FIGS. 1A, 1B, 2A and 2B, preferred embodiments of the present invention are illustrated. FIG. 1A illustrates a gas range burner and its component parts, including a range sensor. FIG. 1B illustrates a gas range burner and its component parts, including a plurality of range sensors. FIG. 2A illustrates a Manual Control Dial for a gas range of the present invention, including a dial sensor. FIG. 2B illustrates a Manual Control Dial for a gas range of the present invention, including a plurality of dial sensors. As shown in FIG. 1A, a burner section of a gas range (not shown) includes a range base or drip tray 10, a burner cap plate 20, a grate 30, gas ports 40, and a spark igniter 50. The grate 30 is typically positioned above the drip tray 10 and the burner cap plate 20. Range PIR sensor 75 may include one or more PIR sensors. When a plurality of range PIR sensors 75 are used, they may be arranged around the perimeter of the burner cap plate 20, as shown in FIG. 1B. The gas ports 40 are drawn protruding for illustrative purposes only. Typically, the gas ports 40 comprise a plurality of openings surrounding the burner and provide gas to the burner flame (not shown). Igniter 50 may be a conventional electronic or electric igniter which generates a spark to ignite the gas exiting gas ports 40. In the preferred embodiment, the gas burner safety system of the present invention is used with an "automatic pilotless ignition" gas range with "automatic electric" or "automatic electronic ignition." An external gas source 60 provides gas to gas ports 40.

FIGS. 1A and 1B further illustrate a Manual Control Dial 70, which may be rotated to open a valve 65 and start the flow of gas from gas source 60 through gas ports 40 while electrically striking a spark via igniter 50 to ignite a flame. Manual Control Dial 70 may be located anywhere proximal to the gas range burner, and the position of Manual Control Dial 70 over the gas source 60 in FIGS. 1A and 1B is not intended to be limiting. Manual Control Dial 70 also controls the level of gas flow and the size of the flame. The preferred valve 65 component of Manual Control Dial 70 is an electromechanical valve type such as a Solenoid Valve that can be opened, closed, and flow-controlled via electrical actuation.

Sensors 75 may be arranged at the center, around the perimeter, or proximal to the gas range burner. The sensors 75 may be PIR sensors, or similar sensors, that may be installed under a heat-resistant, transparent protective layer, such as glass-ceramic, and when spaced and arranged in the appropriate manner, the sensors 75 will be able to determine if a cooking instrument or other object is about the flame. Alternatively, sensors 75 may be one or more optical sensor (s) positioned in spatial relation to the gas range burner such that the optical sensor(s) can detect the burner flame and/or objects about the flame. For example, sensor(s) 75 may comprise camera(s), proximity sensor(s), and the like.

Still referring to FIGS. 1A and 1B, Central Control Unit 300, which includes a microprocessor 200, a logic circuit 210, a memory 220 and a timer 230, receives and processes signals from at least one range PIR sensor 75 and stores the data from the signals in memory 220. Microprocessor 200 is programmed to compare the output from range PIR sensor (s) 75 on a continual or periodic basis. Thus, memory 220 contains "images" of the burner flame taken at different times. Such "images" are outputs from range PIR sensor(s) 75 and may be stored in memory 220 as data tables, for example. Microprocessor 200 may then compare two "images" taken one after the other to determine if the "image" matches the "flame signature" for that burner. Although PIR sensors do not detect motion per se, they effectively can sense the result of movement by measuring differences in temperature at a location where a heat source is modified or removed. Such changes in the heat source occur, for example, when an object is placed above a burner flame or a hand is placed near a Manual Control Dial. Not shown is an electrical power source native to the environment and standard on most gas oven/ranges which powers the clock, light and igniter 50.

The safety burner system of the present invention may further include, as illustrated in FIGS. 1A and 1B, a smoke detector 100, or a gas detector 110. If a predetermined level of smoke is detected by smoke detector 100, Central Control Unit 300 will shut off external gas source 60. Similarly, if a predetermined level of gas is detected by gas detector 110, Central Control Unit 300 will shut off the external gas source 60. Detectors 100, 110 may be connected to Central Control Unit 300 wirelessly or by wire.

As shown in FIGS. 2A and 2B, dial PIR sensor(s) 80 are positioned proximal to the Manual Control Dial 70. Dial PIR sensor(s) 80 may include one or more PIR sensors. Alternatively, sensors 80 may be one or more optical sensor(s) positioned in spatial relation to the Manual Control Dial such that the optical sensor(s) can detect a human hand or other objects about the Manual Control Dial. For example, sensor(s) 80 may comprise camera(s), proximity sensor(s), and the like. The dial PIR sensor(s) 80 may be arranged at the center, around the perimeter, or proximal to the Manual Control Dial 70. Dial PIR sensor(s) 80 are used to detect the presence of a human operator's hand on or around Manual Control Dial 70. In a preferred embodiment, range sensor(s) 75 may be aimed to determine if a cooking utensil is within the proximate vertical perimeter area above the grate 30 shown in FIGS. 1A and 1B. This positioning allows an operator to perform all of the functions of cooking, from leaving a utensil on the grate 30 to raising a pot or pan to flip, stir or taste. The rationale behind this system is that operators typically follow two different behaviors when cooking depending on whether they are using a one-handed utensil such as a pan, or a two-handed utensil such as a pot. When an operator brings a two-handed pot to the range (maybe to boil water), they: (1) get the pot; (2) fill with water; (3) carry it with two hands to the range; and then (4) light the flame. In this instance, our system will remain on because it recognizes the presence of a pot (and also the hand that turns the dial). If the operator removes the pot without remembering the turn off the gas, the system will shut off. When an operator brings a one-handed pan to the range, they often light the flame prior to placing the utensil on the range surface in an effort to visually determine the desired flame intensity or that it has actually lit. In this instance, as long as dial PIR sensor 80 detects the presence of a hand on or around the dial, the gas will continue to flow.

In a further embodiment of the present invention, warning sounds and lights may be used to alert an operator or provide a record for the operator that a flame was left on.

In a preferred embodiment, the safety burner system, including Central Control Unit 300, may be operated as follows:

1. Does dial PIR sensor(s) 80 sense a human operator's hand on or around the proximate region of Manual Control Dial 70?
2. If yes, then the flow of gas continues from gas source 60 through gas ports 40 because the Central Control Unit 300 programming deems that the operator still has control over the gas burner.
3. If no, the gas supply is shut off, unless range PIR sensor(s) 75 simultaneously detect the presence of a cooking utensil or other object, by comparing simultaneous "images" as described herein, on, around, or above the proximate region of the grate 30.

In a still further embodiment, the safety burner system, including Central Control Unit 300, may be operated as follows:

1. When Manual Control Dial 70 is in the OFF position, the Solenoid Coil is de-energized, thus obstructing a flow of gas from the gas source 60 to the gas ports 40.
2. When Manual Control Dial 70 is advanced from the OFF position to any ON position, the Central Control Unit 300 energizes the Solenoid Valve, thus permitting the flow of pressurized gas from the gas source 60 to the gas ports 40.
3. The Central Control Unit 300 can only give either an instruction to open the Solenoid Valve or close the Solenoid Valve, but not both commands simultaneously.
4. For the Manual Control Dial 70 to start the igniter 50, it must first be returned to the OFF position to reset (i.e., post-automatic shut-off when the gas has been shut off, but the Manual Control Dial 70 is left in an ON position).
5. The Manual Control Dial 70 can control the flow level of gas either electronically at the solenoid valve location or at a location down-flow of the Solenoid Valve outlet port if desired and may do so mechanically.
6. The Manual Control Dial 70 is the only means to turn on the flow of gas.
7. The Manual Control Dial 70 is the only means to ignite the gas flame.

In a still further embodiment, the safety burner system, including Central Control Unit 300, may be operated as follows with respect to the automatic shut-off features of the safety burner system:

1. Does the range PIR sensor(s) 75 detect a "flame signature"?
2. If yes, does the dial PIR sensor(s) 80 detect a hand in proximity to Manual Control Dial 70 within a preset time?
3. The information from both the range PIR sensor(s) 75 and the dial PIR sensor(s) 80 is transmitted to the Central Control Unit 300.
4. If a hand is not detected in step 2 above, the Central Control Unit 300 sends a signal that closes the Solenoid Valve and stops the flow of gas, thus extinguishing the flame at the burner.

In a still further embodiment, the safety burner system, including Central Control Unit 300, may also be operated as follows with respect to the automatic shut-off features of the safety burner system:

1. Manual Control Dial 70 is turned to an ON position, starting the flow of gas from the external gas source 60 transporting gas through the numerous gas ports 40 while simultaneously initiating the igniter 50, thus providing a lit flame. From this point, the level of the flame is controlled by Manual Control Dial 70.
2. After step 1 above, the gas supply will only continue if the flame image detected via range PIR sensor(s) 75 around grate 30 is different than the flame signature, or a hand or other object is detected via dial PIR sensor(s) 80 around Manual Control Dial 70.
3. If the gas has been cut off at step 2 above because a pot or pan or other object is not on the grate 30 or within the sight of the range PIR sensor 75 and a hand is not around Manual Control Dial 70, the gas can only be re-started and the flame reignited if Manual Control Dial 70 is manually "re-zeroed" to OFF by an operator, and step 1 is repeated. This confines the human operator to only one familiar means of igniting a flame.
4. The logic circuit 210 can be programmed to instruct the Central Control Unit 300 to shut off the external gas source 60 at any preset time after the Central Control Unit 300 has determined the absence of an object via range PIR sensor(s) 75 and the absence of a human hand via dial PIR sensor(s) 80 (i.e., after 0 seconds to 5 seconds as counted by timer 230). The safety burner system of the present invention may allow consumers to set such time limits.
5. Optionally, Central Control Unit 300 will shut off the external gas supply 60 if smoke detector 100 detects a predetermined level of smoke or if gas detector 110 detects a predetermined level of gas. Those familiar in the art will understand that the location of smoke detector 100 and gas detector 110 will have to be in an area above the range that permits accurate assessment of levels of smoke and gas.

There has been provided, in accordance with the present invention and the embodiments thereof, a burner safety system which uses sensors to determine a "flame signature" for a gas range burner and then determines whether an object is placed above the gas range burner, by comparing the flame "image" to the "flame signature." The burner safety system further uses sensor(s) around the manual control dial used to turn on and off a gas burner and to regulate the size of a burner flame. The sensor(s) around the manual control dial sense when a human hand is present around the dial and this information will allow a burner to stay lit even if a pot or pan is not placed above the burner. There has further been provided in accordance with the present invention a burner safety system which will turn off an unattended gas range burner.

While the invention has been described with specific embodiments, many alternatives, modifications and variations will be apparent to those skilled in the art in light of the foregoing description. For the avoidance of doubt, while the examples herein describe the invention with PIR sensors, other sensors, such as disclosed herein, may be employed. Accordingly, it is intended to include all such alternatives, modifications and variations within the spirit and scope of the appended claims.

What is claimed is:

1. A gas burner safety system for use on a gas range, the gas burner safety system comprising:

a manual control;

a valve operatively connected to the manual control;

a gas supply line having the valve connected across it, such that the valve may shut off and turn on the gas supply line;

a burner on the gas range connected to the gas supply line;

a range sensor placed proximally to the burner, wherein the range sensor detects a first measured attribute of the area proximal to the burner;

a manual control sensor placed proximally to the manual control, wherein the manual control sensor detects a second measured attribute of the area proximal to the manual control;

a central control unit connected to the range sensor, the manual control sensor, and the valve, the central control unit including a memory;

a detector connected to the central control unit, the detector being configured to accurately assess levels of emissions emanating from the range;

a first stored attribute for the burner stored in the memory;

a second stored attribute for the manual control stored in the memory;

a predetermined level of an emission stored in the memory;

wherein the first measured attribute may be the same or different than the first stored attribute and the second measured attribute may be the same or different than the second stored attribute;

wherein the central control unit is configured to close the valve which shuts off the gas supply line based on a comparison of the first measured attribute to the first stored attribute, and a comparison of the second measured attribute to the second stored attribute; and wherein the central control unit is configured to close the valve which shuts off the gas supply line when the detector detects a level of the emission that meets or exceeds the predetermined level.

2. The gas burner safety system of claim 1, wherein the detector is wirelessly connected to the central control unit.

3. The gas burner safety system of claim 1, wherein the range sensor is wirelessly connected to the central control unit.

4. The gas burner safety system of claim 1, wherein the manual control sensor is wirelessly connected to the central control unit.

5. The gas burner safety system of claim 1, wherein the detector is a smoke detector and the emission is smoke.

6. The gas burner safety system of claim 1, wherein the detector is a gas detector and the emission is gas.

7. The gas burner safety system of claim 1 further comprising a plurality of detectors and predetermined levels of a plurality of emissions stored in the memory, wherein at least one of the detectors is a smoke detector and at least one of the detectors is a gas detector, and wherein at least one of the emissions is smoke and at least one of the emissions is gas.

8. The gas burner safety system of claim 7, wherein one or more of the detectors are wirelessly connected to the central control unit.

9. The gas burner safety system of claim 1, further comprising one or more lighted warnings configured to alert an operator of the gas burner safety system to a valve status selected from the group consisting of an open valve and a closed valve.

10. The gas burner safety system of claim 1, further comprising one or more audible warnings configured to alert an operator of the gas burner safety system to a valve status selected from the group consisting of an open valve and a closed valve.

11. The gas burner safety system of claim 1, wherein the system is configured to store data in the memory to provide a record of when the valve was in an open or closed position.

12. The gas burner safety system of claim 1 further comprising one or more lighted warnings configured to alert an operator of the gas burner to a valve status selected from the group consisting of an open valve and a closed valve, wherein the system is also configured to store data in the memory to provide a record of when the lighted warnings were triggered by the system.

13. The gas burner safety system of claim 1 further comprising one or more audible warnings configured to alert an operator of the gas burner to a valve status selected from the group consisting of an open valve and a closed valve, wherein the system is also configured to store data in the memory to provide a record of when the audible warnings were triggered by the system.

14. The gas burner safety system of claim 1, wherein the range sensor is one of a plurality of range sensors.

15. The gas burner safety system of claim 1, wherein the manual control sensor is one of a plurality of manual control sensors.

16. The gas burner safety system of claim 1, wherein the range sensor is selected from the group consisting of a camera and a proximity sensor.

17. The gas burner safety system of claim 1, wherein the manual control sensor is selected from the group consisting of a camera and a proximity sensor.

18. The gas burner safety system of claim 1, wherein the first measured attribute is a flame image.

19. The gas burner safety system of claim 1, wherein the first stored attribute is a flame signature.

20. The gas burner safety system of claim 1, wherein the second stored attribute is a temperature of a human hand.

* * * * *